US008397356B2

(12) United States Patent
Pak et al.

(10) Patent No.: US 8,397,356 B2
(45) Date of Patent: Mar. 19, 2013

(54) TRIPLE BAR, HIGH EFFICIENCY MECHANICAL SEALER

(75) Inventors: Donald J. Pak, Martinez, GA (US); Samantha A. Hawkins, Athens, GA (US); John E. Young, Aiken, SC (US)

(73) Assignee: U.S. Department of Energy, Washington, DC (US)

( * ) Notice: Subject to any disclaimer, the term of this patent is extended or adjusted under 35 U.S.C. 154(b) by 410 days.

(21) Appl. No.: 12/590,518

(22) Filed: Nov. 10, 2009

(65) Prior Publication Data

US 2010/0115742 A1 May 13, 2010

Related U.S. Application Data

(60) Provisional application No. 61/113,246, filed on Nov. 11, 2008.

(51) Int. Cl.
*B42F 1/00* (2006.01)
*B30B 5/00* (2006.01)
*B30B 7/00* (2006.01)

(52) U.S. Cl. ..... 24/569; 100/257; 100/266; 100/289

(58) Field of Classification Search ..... 24/569, 24/568, 525, 514; 72/293, 295; 269/43, 269/45, 166, 165, 95; 100/257, 266, 289
See application file for complete search history.

(56) References Cited

U.S. PATENT DOCUMENTS

| | | | | | |
|---|---|---|---|---|---|
| 41,632 | A | | 2/1864 | Mitchell | |
| 195,429 | A | * | 9/1877 | Woodhull | 100/289 |
| 527,714 | A | | 10/1894 | Nixon | |
| 557,452 | A | * | 3/1896 | Thompson | 269/158 |
| 801,102 | A | * | 10/1905 | Quay | 100/257 |
| 996,244 | A | * | 6/1911 | Hess | 269/204 |
| 1,566,867 | A | | 2/1925 | Hetzer | |
| 1,783,985 | A | | 1/1929 | Sherts | |
| 2,525,204 | A | * | 10/1950 | Calabro | 100/214 |
| 2,917,956 | A | | 6/1958 | Merion | |
| 2,886,080 | A | * | 5/1959 | Rappeport | 269/87.3 |
| 3,051,473 | A | * | 8/1962 | Juhase | 269/95 |
| 4,405,002 | A | * | 9/1983 | Catalano | 144/2.1 |
| 5,257,525 | A | | 11/1993 | Clarke | |
| 5,513,837 | A | * | 5/1996 | Osborn | 269/127 |
| 5,921,601 | A | | 7/1999 | Buckles | |
| 6,250,620 | B1 | * | 6/2001 | Durfee, Jr. | 269/43 |

* cited by examiner

*Primary Examiner* — Robert J Sandy
*Assistant Examiner* — Rowland D Do
(74) *Attorney, Agent, or Firm* — Daniel T. Lamb; John T. Lucas

(57) ABSTRACT

A clamp with a bottom clamp bar that has a planar upper surface is provided. The clamp may also include a top clamp bar connected to the bottom clamp bar, and a pressure distribution bar between the top clamp bar and the bottom clamp bar. The pressure distribution bar may have a planar lower surface in facing relation to the upper surface of the bottom clamp bar. An object is capable of being disposed in a clamping region between the upper surface and the lower surface. The width of the planar lower surface may be less than the width of the upper surface within the clamping region. Also, the pressure distribution bar may be capable of being urged away from the top clamp bar and towards the bottom clamp bar.

18 Claims, 4 Drawing Sheets

TRIPLE BAR, HIGH EFFICIENCY MECHANICAL SEALER

CROSS REFERENCE TO RELATED APPLICATION

This application claims the benefit of U.S. application Ser. No. 61/113,246 filed on Nov. 11, 2008 and entitled, "Triple Bar, High Efficiency Mechanical Sealer." U.S. application Ser. No. 61/113,246 is incorporated by reference herein in its entirety for all purposes.

STATEMENT AS TO RIGHTS TO INVENTIONS MADE UNDER FEDERALLY SPONSORED RESEARCH AND DEVELOPMENT

This invention was made with Government support under Contract No. DE-AC09-96SR18500 awarded by the United States Department of Energy. The Government has certain rights in the invention.

FIELD OF THE INVENTION

This invention is directed towards a mechanical sealer which is designed to provide even pressure along the length of a bag opening which provides for an efficient, temporary seal of a storage bag. The storage bag may hold any number of a variety of materials, including hazardous waste, various fluids, gases, and mixtures thereof.

BACKGROUND OF THE INVENTION

This invention relates to clamping devices. A variety of carpenter's clamps, clamping tools, crimping devices, and similar apparatuses are known within the art. While a variety of clamps such as carpenter's clamps are known, such clamping devices have proven to be inadequate to provide a tight, uniform seal across an opening of a plastic bag. Accordingly, there remains room for variation and improvement within the art.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
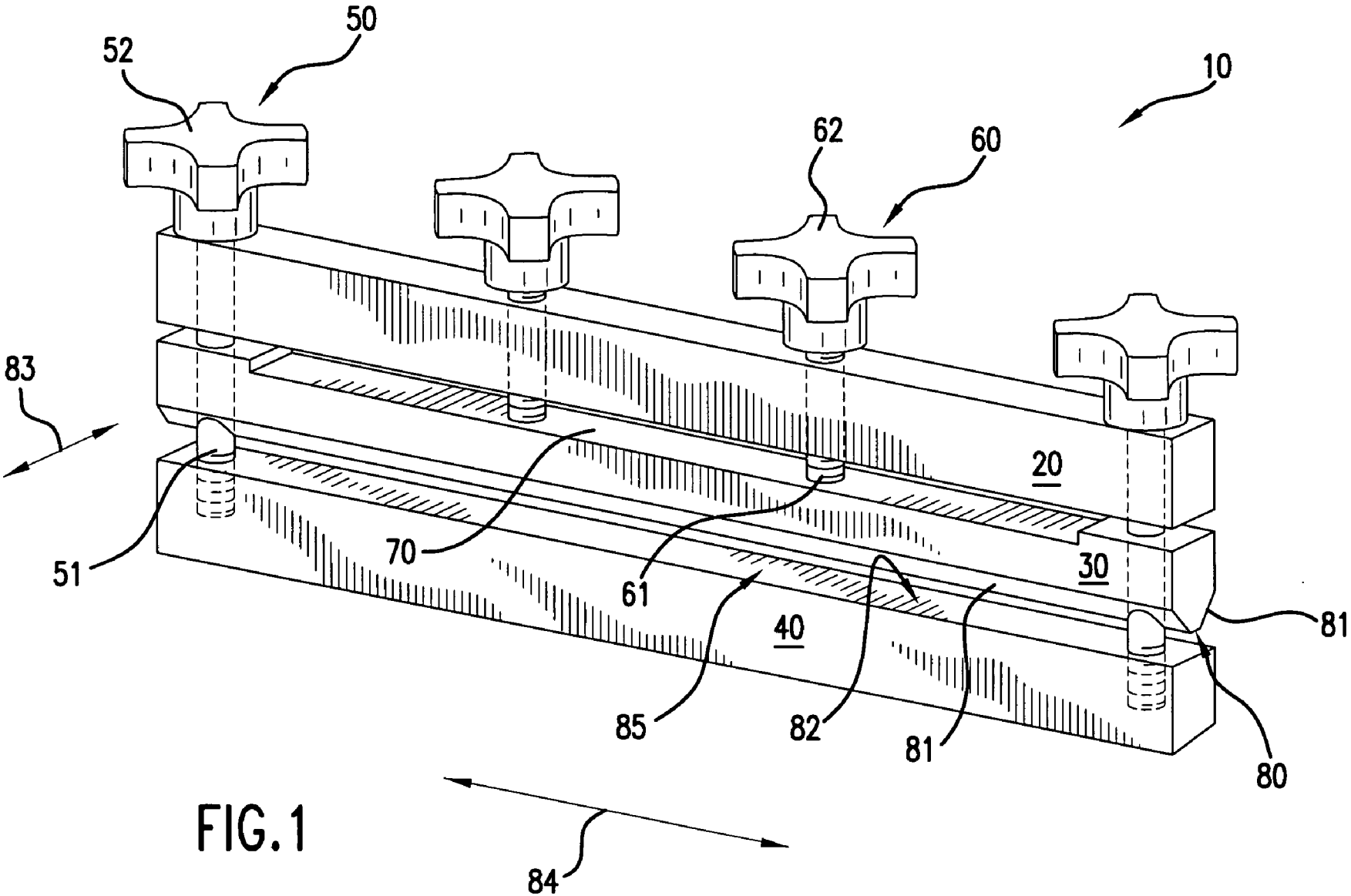
FIG. 1 is a perspective view of an embodiment of the present invention.
Figure 2:
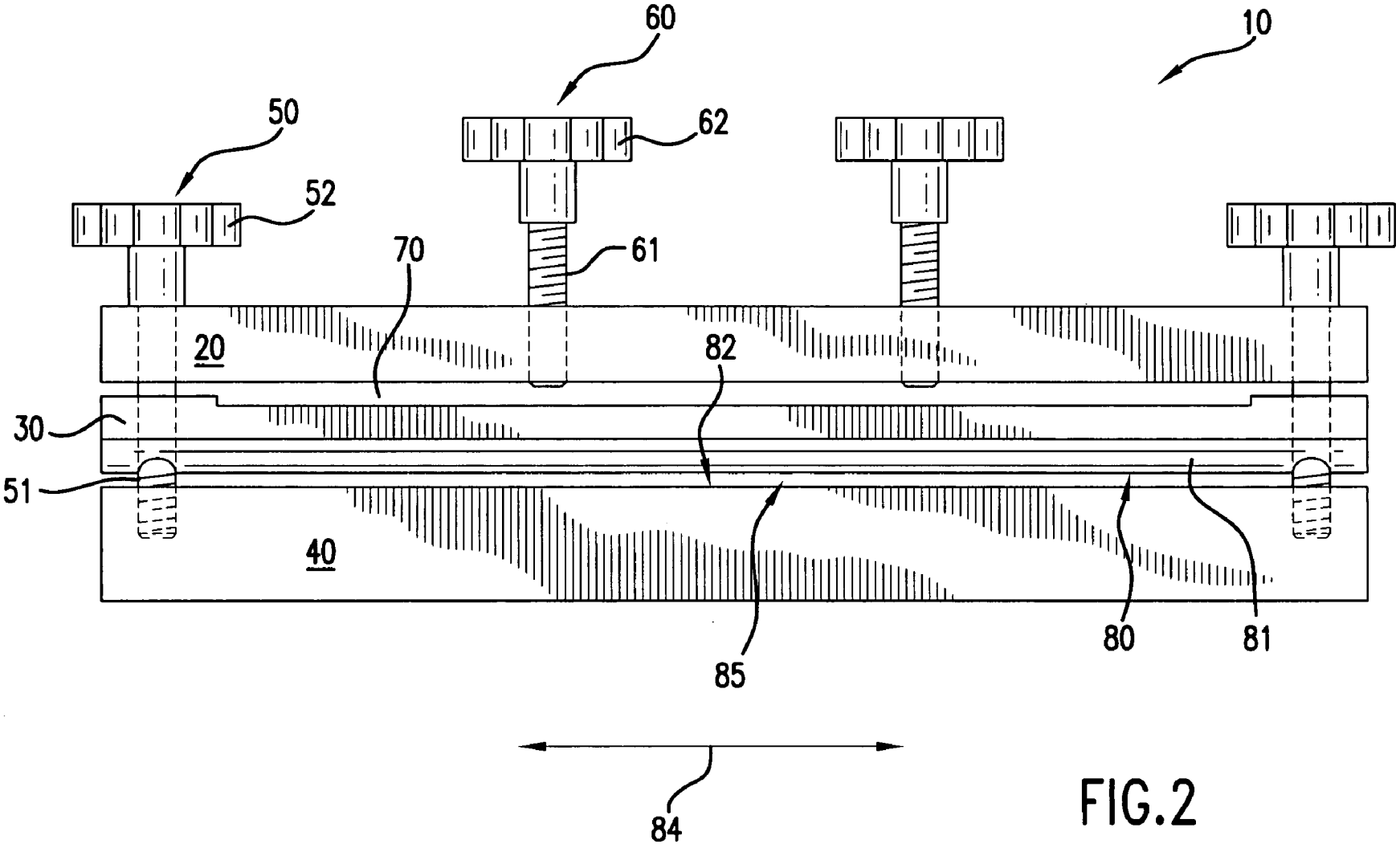
FIG. 2 is a front elevation view of the clamp sewn in FIG. 1.

As set forth in FIGS. 1 and 2, a clamp apparatus 10 is disclosed which has an upper bar 20, a bottom bar 40, and an intervening pressure distribution bar 30. As seen in FIG. 1, a lower surface of pressure distribution bar 30 defines a tapered but flat surface for engagement against an upper surface of bottom pressure bar 40.

Figure 3:
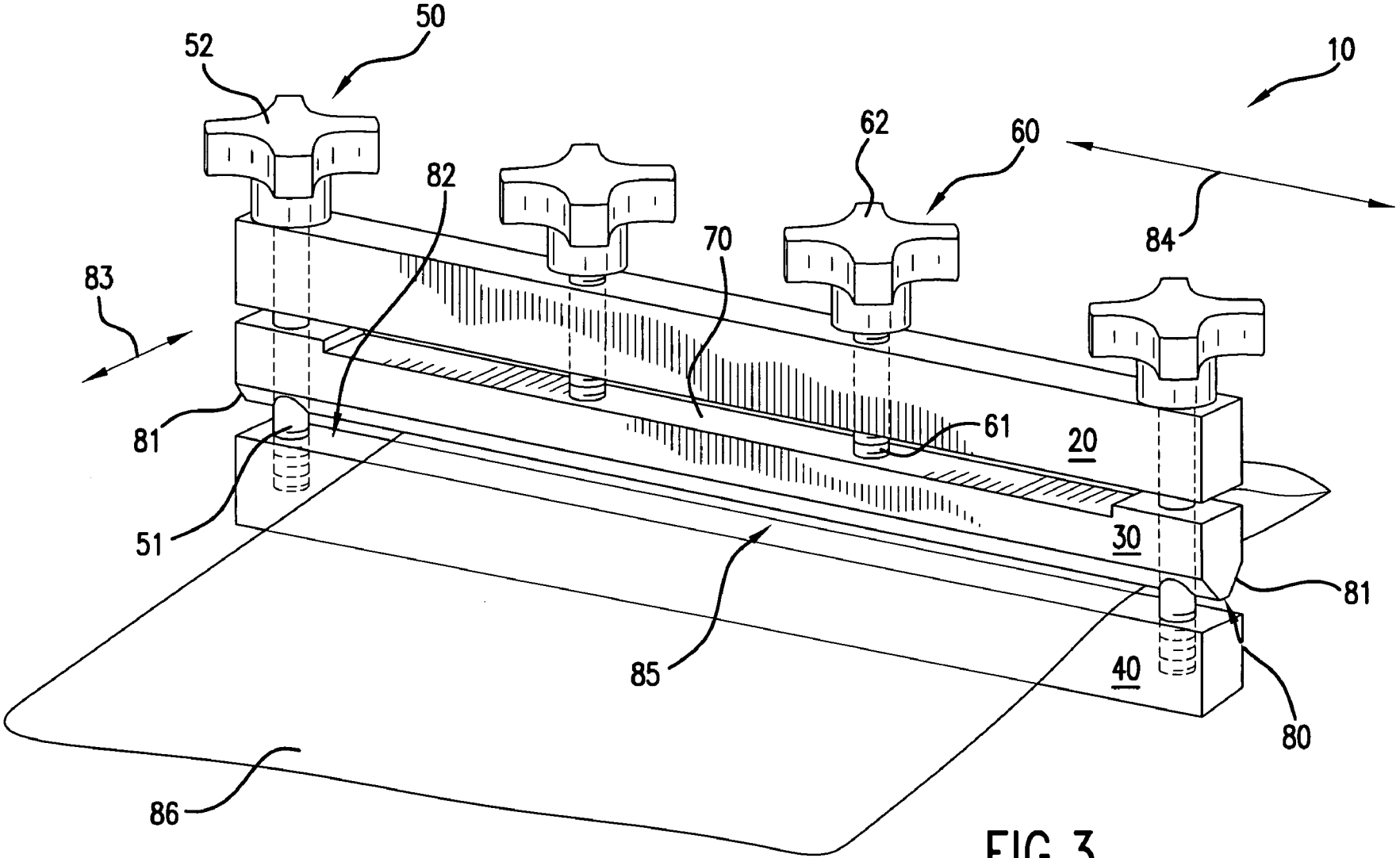
FIG. 3 is a perspective view of the embodiment of FIG. 1 in which an object is present in the clamp.

A clamp assembly 50 is supported at either end of the clamp 10, the clamp assembly comprising a threaded connector 51 which extends along the edge of the clamp 10 through respective apertures and extends through the upper bar 20 and pressure distribution bar 30. Connector 51 further extends at least partway into the bottom clamp bar 40 through respective apertures defined within the bottom clamp bar 40. The engagement between the threaded connector 51 and the bottom clamp bar 40 may be a threaded engagement, and the threaded connector 51 need not be in threaded engagement with the upper bar 20 and/or the pressure distribution bar 30. However, it is to be understood that other exemplary embodiments exist in which the threaded connector 51 is in threaded engagement with the upper bar 20 and/or the pressure distribution bar 30. A clamping region 85 may be defined between the threaded connectors 51, the flat lower surface 80, and the flat upper surface 82 into which an object 86 as shown in FIG. 3 may be positioned. The clamping region 85 may be the portion of the flat lower surface 80 that is capable of engaging the object 86 and the length of the flat upper surface 82 that extends along the length of the flat lower surface 80 that is capable of engaging the object 86. As such, the cavities formed on the flat lower surface 80 due to the presence of the threaded connectors 51, along with those possibly formed on the upper surface 82 due to the threaded connectors 51 in other embodiments, need not form part of the clamping region 85.

Figure 4:
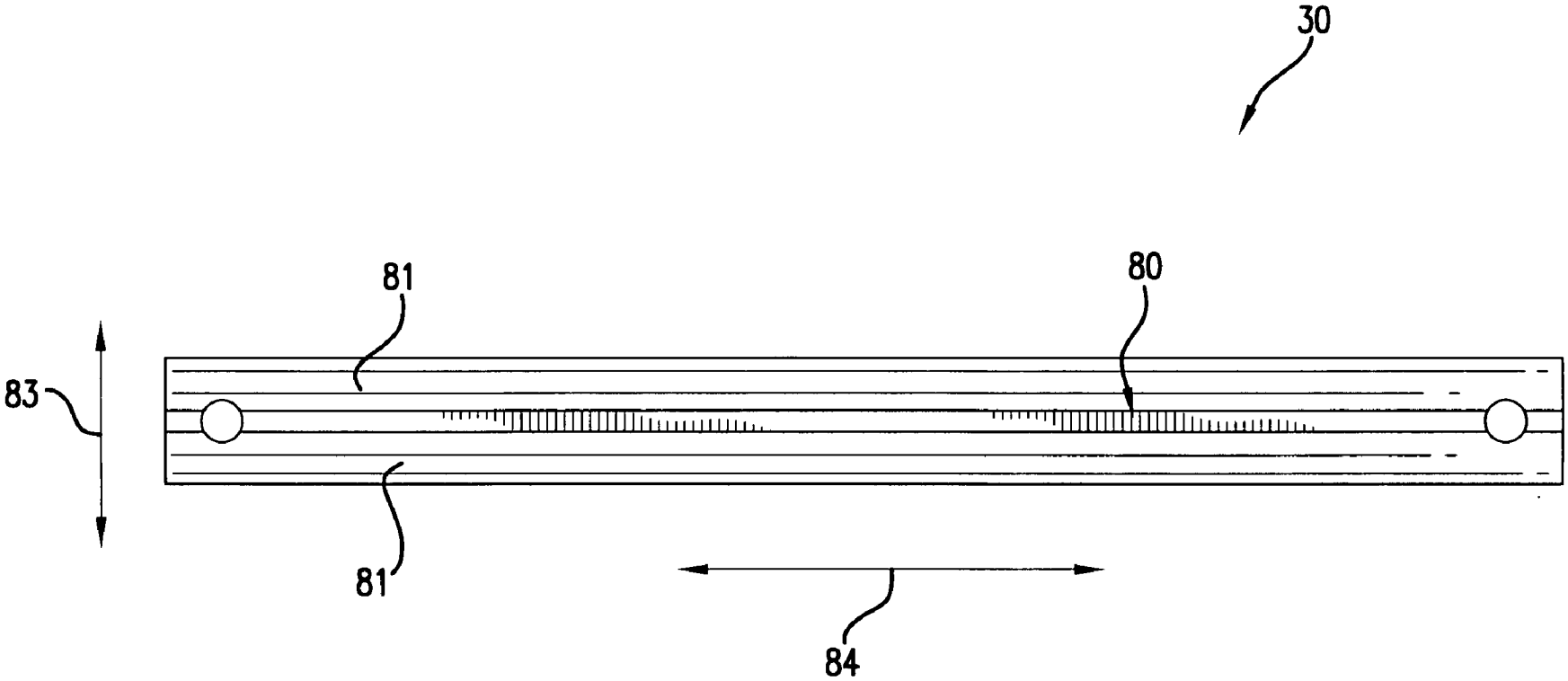
FIG. 4 is a bottom view of a pressure distribution bar.

In order to provide additional pressure to an object 86 placed between bottom clamp bar 40 and pressure distribution bar 30, a pressure assembly 60 is provided comprising a threaded connector 61 which extends through the top clamp bar through a respective aperture and extends partially into the pressure distribution bar 30. In certain exemplary embodiments the threaded connector 61 engages the top of the pressure distribution bar 30 and does not extend therein and can be urged against the top of the pressure distribution bar 30 so as to cause the pressure distribution bar 30 to be urged towards the bottom clamp bar 40. The threaded connector 61 may be in threaded engagement with the upper bar 20 and need not be in threaded engagement with the pressure distribution bar 30. Both the clamp assembly 50 and the pressure assembly 60 each have respective tighteners 52/62 for receiving a threaded end of the respective threaded connectors 51/61 so as to provide a clamping force by the engagement and tightening of the threaded connections. As seen, a gap 70 is defined between upper bar 20 and pressure distribution bar 30. As seen in reference to the figures, the lower surface of the pressure distribution bar 30 has, in the illustrated embodiment, a reduced width as reflected by the tapered sidewalls 81 which taper into a flat lower surface 80 of pressure distribution bar 30. The reduced surface area of the resulting lower surface 80 provides for a decreased surface area of engagement which allows for a greater amount of pressure to be applied via the reduced dimensions of the engagement surface. A width direction 83 and a length direction 84 are denoted in FIG. 1 for reference. The pressure distribution bar 30 may thus have a maximum width that is greater than the width of the flat lower surface 80 along the entire length of the pressure distribution bar 30. In this manner, the upper surface of the pressure distribution bar 30 may have a width that is greater than the flat lower surface 80 of the pressure distribution bar 30. The upper surface 82 of the bottom bar 40 may be wider than the flat lower surface 80 along the entire lengths of the upper surface 82 and the flat lower surface 80 that engage the object 86. In certain embodiments, the upper surface 82 may have the same width as the upper surface of the pressure distribution bar 30 along the entire lengths of the pressure distribution bar 30 and the bottom bar 40. With such an arrangement, the area of the flat lower surface 80 may be less than the area of the upper surface 82. Also, the area of the flat lower surface 80 may be less than the area of the upper surface of the pressure distribution bar 81. A bottom view of the pressure distribution bar 81 in accordance with one exemplary embodiment is illustrated in FIG. 4.

Although shown as having the tapered sidewalls 81 and the flat lower surface 80 on the pressure distribution bar 81, the clamp apparatus 10 can be reconfigured so that the bottom bar 40 is instead fitted with tapered sidewalls and a flat upper surface that has a width that is less than the width of the bottom surface of the pressure distribution bar 81 that is a flat surface. In effect, the arrangement of the bottom of the pressure distribution bar 81 and the arrangement of the top of the bottom bar 40 can be reversed in accordance with other exemplary embodiments.

As the clamp assemblies 50 are used to provide a compressive tightening force between the upper bar 20, the pressure distribution bar 30, and the bottom clamp bar 40, the pressure assembly 60 is used to exert pressure against distribution bar 30, thereby pressing the bottom surface 80 of pressure bar 30 against the upper surface 82 of the bottom bar 40. While the illustrated embodiment shows two pressure assemblies 60, the number and spacing of the assemblies may be varied so as to achieve a uniform sealing pressure to a bag inserted between pressure distribution bar 30 and bottom clamp bar 40. It is recognized and understood that a uniform pressure needs to be applied across the length of the pressure distribution bar 30 to avoid areas of unequal and inadequate sealing pressure that may result in leaks along the sealed bag area.

As further seen in reference to the illustrated embodiments, a gap region 70 is defined between the top clamp bar 20 and the pressure distribution bar 30.

The gap 70 as illustrated is formed by a recessed area defined by the upper surface of pressure distribution bar 30 and which also defines the surface in which the threaded connectors 61 engage the upper flat surface of the pressure distribution bar 30.

It is recognized that an equivalent functioning gap could be established by providing a similar recessed area along the lower surface of upper bar 20 which would accomplish substantially the same functional arrangement for the clamp assembly 50.

One representative use of the clamp 10 is for placement of a plastic storage bag the opening of which is inserted between the bottom clamp bar 40 and the pressure distribution bar 30. By tightening the clamping assembly 50 and the pressure assembly 60, a uniform pressure is exerted against the bag edges, thereby sealing the bag. In accordance with this invention, it has been found that absent a uniform pressure applied across the entire width of the clamp, a tight seal of the bag may not occur resulting ir. loss of integrity of the bag contents. Depending upon the nature of the contents, the loss of bag integrity can have important implications. For instance, the clamp assembly may be used as a temporary closure for transporting hazardous waste or material from one location to another. Likewise, evidence bags used by law enforcement for field collection of samples or evidence can also be temporarily sealed until more permanent sealed transfers can be carried out in a laboratory or secure facility.

The clamp assembly 50 allows a seal of a plastic bag that passes current leak and biological challenge performance tests. For instance, a sealed glove bag has been demonstrated to provide a safe seal to safely handle pathogenic organisms. The integrity of the seal was sufficient for allowing items to be transferred using a "safe bag-in" process where items may be inserted into an open end of a mechanically sealed bag-out sleeve within a glove box or other containment device. The open end is then sealed and can be removed from the original seal allowing the item to be inserted into a sealed glove bag.

The clamp set forth above was tested using inflatable PVC sleeves having 8" and 12" respective diameters. The clamp was used to seal one end of the PVC sleeve while the other end was attached to a 1" water column. After 30 minutes, the seal integrity was found to have lost less than 4% of the water column in the 12" sleeve and with less than 1% loss detected within the 8" sleeve.

While the preferred embodiment of the clamp is envisioned for use as a temporary seal for plastic bags and similar pliable containers, it is recognized that the more uniform clamping pressure also lends itself for use of the clamp in other areas such as a woodworking clamp, various industrial clamping needs such as metal bending, and similar applications. While the disclosed embodiments are in reference to various members having straight, flat edges, the same concept could be used to devise an arcuate shaped clamp in which the top clamp bar, the bottom clamp bar, and the pressure distribution bar are all formed from similarly shaped arcuate materials such that the components will tightly nest when subjected to the closure forces of the clamp assembly and the pressure assembly arms.

Suitable materials for use of the clamping members include stainless steel and other metals, wood, and may optionally include resilient materials such as rubber stripping or use of a resilient pad or surface associated with one or more of the clamping surfaces.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole or in part. Therefore, the spirit and scope of the invention should not be limited to the description of the preferred versions contained therein.

The invention claimed is:

1. A clamp, comprising:

a bottom clamp bar;

a top clamp bar;

a pressure distribution bar positioned between the top clamp bar and the bottom clamp bar wherein the pressure distribution bar defines a lower surface opposite the bottom clamp bar that has a surface area less than a surface area of an upper surface of the bottom clamp bar;

a clamp assembly operatively engaging the bottom clamp bar, the top clamp bar, and the pressure distribution bar which, when engaged, draws the bottom clamp bar, top clamp bar, and pressure distribution bar together, wherein the clamp assembly has a threaded connector that extends through the pressure distribution bar, wherein the threaded connector is surrounded only by the pressure distribution bar between the bottom clamp bar and the top clamp bar;

a pressure assembly arranged at spaced locations across the top clamp bar which, when engaged, moves the pressure distribution bar against the bottom clamp bar; and wherein, when an object is placed between the bottom clamp bar and the pressure distribution bar and the clamp assembly is tightened and the pressure assembly is tightened, the object is firmly held between the bottom clamp bar and the pressure distribution bar.

2. The clamp as set forth in claim 1 further comprising the object, wherein the object is a plastic bag.

3. The clamp as set forth in claim 1 wherein a lower surface of the pressure distribution bar defines a flat surface, the flat surface having a width less than a width of the upper surface of the pressure distribution bar.

4. The clamp as set forth in claim 1 wherein when the clamp is in a tightened configuration at least one of a lower surface of the top clamp bar or an upper surface of the pressure distribution bar defines a recessed surface such that a gap is formed between the top clamp bar and the pressure distribution bar.

5. A clamp, comprising:

a bottom clamp bar having an upper surface that is planar;

a top clamp bar connected to the bottom clamp bar;

a pressure distribution bar located between the top clamp bar and the bottom clamp bar, wherein the pressure distribution bar has a planar lower surface in facing relation to the upper surface of the bottom clamp bar, wherein an object is capable of being disposed in a clamping region between the upper surface of the bottom clamp bar and the lower surface of the pressure distribution bar, wherein the width of the planar lower surface is less than the width of the upper surface of the bottom clamp bar within the clamping region, wherein the pressure distribution bar is capable of being urged away from the top clamp bar and towards the bottom clamp bar; and a clamp assembly that functions to connect the top clamp bar to the bottom clamp bar and that can be actuated in order to urge the top clamp bar and the bottom clamp bar towards one another, wherein the clamp assembly has a threaded connector that extends through the pressure distribution bar, wherein the threaded connector is surrounded only by the pressure distribution bar between the bottom clamp bar and the top clamp bar.

6. The clamp as set forth in claim 5, wherein the width of the planar lower surface is less than the width of the upper surface of the bottom clamp bar along the entire lengths of the planar lower surface and the upper surface of the bottom clamp bar.

7. The clamp as set forth in claim 5, wherein the clamp assembly includes another threaded connector wherein the threaded connectors are in threaded engagement with the bottom clamp bar, and wherein the clamp assembly includes at least two tighteners located at the top clamp bar that can be actuated in order to cause rotation of the two threaded connectors to urge the top clamp bar and the bottom clamp bar towards one another.

8. The clamp as set forth in claim 5, further comprising a pressure assembly that functions to urge the pressure distribution bar away from the top clamp bar and towards the bottom clamp bar, wherein the pressure assembly includes at least two threaded connectors that are in threaded engagement with the top clamp bar, and wherein the pressure assembly includes at least two tighteners located at the top clamp bar that can be actuated in order to cause rotation of the at least two threaded connectors to urge the pressure distribution bar away from the top clamp bar and towards the bottom clamp bar.

9. The clamp as set forth in claim 7, wherein the two threaded connectors are urged against an upper surface of the pressure distribution bar.

10. The clamp as set forth in claim 7, wherein the two threaded connectors extend within the pressure distribution bar.

11. The clamp as set forth in claim 5, further comprising the object, wherein the object is a plastic bag.

12. The damp as set forth in claim 5, wherein the area of the planar lower surface is less than the area of the upper surface of the bottom clamp bar within the clamping region.

13. The clamp as set forth in claim 5, wherein when the clamp is in a thightened configuration a gap is present between a lower surface of the top clamp bar and an upper surface of the pressure distribution bar.

14. The clamp as set forth in claim 5, wherein the pressure distribution bar has a pair of tapered side walls that terminate at the planar lower surface of the pressure distribution bar.

15. A damp, comprising:

a bottom clamp bar having an upper surface that is planar;

a top clamp bar;

a pressure distribution bar located between the top clamp bar and the bottom clamp bar, wherein the pressure distribution bar has a planar lower surface in facing relation to the upper surface of the bottom clamp bar, wherein an object is capable of being disposed in a clamping region between the upper surface of the bottom clamp bar and the lower surface of the pressure distribution bar, wherein the area of the planar lower surface is less than the area of the upper surface of the bottom clamp bar;

a clamp assembly that connects the top clamp bar to the bottom clamp bar and that can be actuated in order to urge the top clamp bar and the bottom clamp bar towards one another, wherein the clamp assembly has a threaded connector that extends through the pressure distribution bar, wherein the threaded connector is surrounded only by the pressure distribution bar between the bottom clamp bar and the top clamp bar; and a pressure assembly that urges the pressure distribution bar away from the top clamp bar and towards the bottom clamp bar, wherein the pressure assembly is located between the clamp assembly in the length direction of the clamp.

16. The clamp as set forth in claim 15, wherein the width of the planar lower surface is less than the width of the upper surface of the bottom clamp bar along a length of the pressure distribution bar and along a length of the bottom clamp bar within the clamping region of the clamp.

17. The clamp as set forth in claim 15, wherein the pressure distribution bar has a pair of tapered side walls that terminate at the planer lower surface, and wherein the entire upper surface of the bottom clamp bar is planar.

18. The clamp as set forth in claim 15, further comprising the object, wherein the object is a plastic bag.

* * * * *